United States Patent [19]

Heller et al.

[11] Patent Number: 4,714,500

[45] Date of Patent: Dec. 22, 1987

[54] METHOD FOR THERMAL TREATMENT OF PEARLITIC RAIL STEELS

[75] Inventors: Wilhelm Heller; Jürgen Flügge, both of Duisburg; Gerhard Ratz, Butzbach, all of Fed. Rep. of Germany

[73] Assignee: Krupp Stahl AG, Bochum, Fed. Rep. of Germany

[21] Appl. No.: 803,744

[22] Filed: Dec. 2, 1985

[30] Foreign Application Priority Data

Dec. 21, 1984 [DE] Fed. Rep. of Germany ..... 3446794

[51] Int. Cl.[4] ..... C21D 9/04

[52] U.S. Cl. ..... 148/12 R; 148/134; 148/154

[58] Field of Search ..... 148/146, 134, 154, 12 R

[56] References Cited

U.S. PATENT DOCUMENTS 4,082,577 4/1978 Heller ..... 148/134

*Primary Examiner*—R. Dean

*Attorney, Agent, or Firm*—Sprung Horn Kramer & Woods

[57] ABSTRACT

The present invention relates to a method for thermal treatment of pearlitic rail steel. For increasing strength and wear resistance steels with the claimed composition are produced with a fine lamellar pearlite structure by heat treatment. During the first cycle the rail head portion is heated in a sufficient depth of up to 50 mm by means of a burner or an inductive system to an austenitization temperature of about 950° to 1050° C. Thereafter the heated head portion is cooled by means of compressed air in such a way that in a first step by blowing a large amount of air the temperature of the rail head portion is cooled within 10 to 20 s to 650° to 600° C. before the area of the pearlitic transformation. In a second step with throttled blowing compared to the first step in the area of the pearlitic transformation the rail head portion is cooled within 2 to 4 minutes to about 400° C. until finishing the pearlitic transformation. Then the rail head portion is again heated for 4 to 6 minutes to a temperature of about 600° to 650° C. and then rapidly cooled by means of water or other appropriate quenching media to a temperature of less than 100° C.

6 Claims, 2 Drawing Figures

METHOD FOR THERMAL TREATMENT OF PEARLITIC RAIL STEELS

BACKGROUND OF THE INVENTION

A method for heat treatment or rail steels in which the complete rail or only the head portion of the rail is heated to austenitization temperature and thereafter cooled so rapidly that through transformation in the lower pearlite stage a fine lamellar pearlite structure is obtained, is known from "Stahl und Eisen", 1970, No. 17, page 926 and following. It is the objective of such thermal treatment processes to produce in rails presenting a guide analysis in compliance with class 90 A of UIC print 860-V, respectively according to AREA-standard (0.60 to 0.75% carbon, 0.80 to 1.30% manganese, up to 0.50% silicon) at the contact surface of the rails up to a depth of at least 10 mm a fine pearlitic structure. Said fine pearlitic structure provide increased resistance against wear and a four to six time higher service life compared to non heat treated rails.

In said methods the usual austenitization temperature is between 850° to 900° C. The heating is performed in a furnace by an electrical induction system, or by a gas burner. Rapid cooling is obtained by oil quenching or blowing of water vapor, water jet or compressed air.

The hardness values obtained by such a process range between 320 and 380 HV at the contact surface. Towards the middle of the rail head portion hardness drops in compliance with the heat treatment process progressively or abruptly to about 280 to 300 HV.

Such heat-treated rails are used on highly frequented rail sections, narrow curvatures and/or at axial loads of more than 200 kN or in switches.

Nevertheless, for particularly excessive loads the strength and wear resistance of the known heat-treated rails are not sufficient. An increase in strength by maintaining the desired fine pearlitic structure profitable for wear characteristics by admixture of strength increasiang alloy elements such as chromium, manganese, nickel and molybdenum is not possible since in the described heat treatment the admixture of these alloy elements causes a transformation partly in bainite and martensite instead of a transformation in the lower pearlitic stage thus producing structures which have a negative influence on wear characteristics and resistance against rupture.

From "Technische Mitteilungen Krupp, Werksberichte", Vol. 37 (1979), pages 79 to 94 highly resistant pearlitic rail steels are known which have a fine grain structure with small interlamellar spacing and low thickness of the cementite and ferrite lamellas after admixture of a maximum of 1.4% chromium and up to 2% nickel. Compared to a steel comprising about 0.75% carbon and about 1% manganese a tensile strength of up to 1350 N/mm$^2$ in natural hardness—air cooled—condition, an increase of said strength by heat treatment, for instance accelerated cooling into the area of the lower pearlite stage, leads to the above mentioned undesired portions of bainite and martensite in the structure.

It is an object of the present invention to further develop a method for heat treatment of rail steels of the above type. Maintaining the fine lamellar pearlitic structure at the rail contact surface hardness values shall be obtained of more than 380 HV, said hardness still reaching values of more than 360 HV in a depth of 15 mm below the rail contact surface.

SUMMARY OF THE INVENTION

This object is solved in that rail steels with the following compositions 0.55 to 0.82% carbon
0.25 to 0.50% silicon
0.80 to 1.30% manganese
≦0.035% phosphorous
≦0.040% sulfur
≦0.30% chromium
≦0.10% nickel
≦0.05% molybdenum
0.05 to 0.20% vanadium
0.02 to 0.10% columbium
0.010 to 0.025% nitrogen
0.010 to 0.070% aluminum the rest being iron and usual melt impurities, are heat-treated in the following manner:

heating the rail portion during the cycle to a sufficient depth of up to 50 mm by means of a gas burner or an electrical induction system to an austenitisation temperature in the range of about 950° to 1050° C., and subsequently cooling by means of compressed air in such a way that in a first step during which a large amount of air is blown onto the workpiece the temperature of the rail head portion is cooled within 10 to 20 seconds to about 650° to 600° C. before the pearlite transformation area, and in a second step at reduced air blowing compared to the first step the material is cooled in the pearlite transformation area within 2 to 4 minutes to about 400° C. until the pearlite transformation is finished, whereafter the rail head portion is again heated for 4 to 6 minutes to about 600° to 650° C. and then rapidly cooled by means of water or another appropriate quenching medium to a temperature of less than 100° C.

Through the addition of vanadium in the range of about 0.05 to 0.20% in connection with the nitrogen content of about 0.010 to 0.025% after finishing the heat treatment there are present in the ferrite lamellas of the laminated pearlite finely dispersed precipitations of vanadium nitrides.

These finely dispersed precipitations cause an increase in strength by precipitations hardening which, due to the adjustment of a small interlamellar spacing, superposes the phase interface hardening. This increases the hardness of the rails heat-treated according to the invention. Steels free of vanadium do not show such strength characteristics.

A main feature for the success is in particular the combination of the austenitization temperature of about 950° to 1050° C., which lies above respective temperatures in known heat treatments, with the heating of the rail head portion to 600° to 650° C. after finishing the pearlite transformation. The second heating of the rail head portion leads to complete precipitations of finest vanadium carbonitride particles from the oversaturated solution, which comprises vanadium, nitrogen and carbon after austenitisation to 950° to 1050° C. During accelerated cooling to temperatures of about 400° C. the precipitations of the vanadium carbonitride particles may be performed only incompletely, so that the desired increase in strength will occur only partly.

When the vanadium carbides or vanadium carbonitrides are precipitations in fine dispersion, the rail head portion is then cooled rapidly by means of water or other appropriate quenching media to a temperature of less than 100° C.

Second heating of the rail head portion to 600° to 650° C. therefore causes complete hardening through precipitations of finest vanadium carbides or vanadium carbonitrides. The preceding cooling of the rail head portion to about 400° C. ensures that the transformation in the pearlite stage will be finished and that subsequent hardening may be performed at high germproof.

The addition of columbium in a range of about 0.02 to 0.10% causes additional segregation hardening. To avoid grain growth during austenitization aluminum from about 0.010 to 0.070% is added.

It is furthermore recommended to use a steel composition according to claim 2 which is restricted in the various elements. For accelerated cooling there may be added to the compressed air, in particular in the first cooling stage, further liquid media such as water or water vapor.

The rails may also be treated in hot-forming condition at rolling finish temperatures of 950° to 1000° C. In this method the heating to austenitization temperature can be deleted, thus saving energy costs. The structure of the rail head portion is again converted to a fine lamellar pearlite by blowing of compressed air. After finishing the pearlite transformation at 400° C. the rail head portion is reheated to about 600° to 650° C. The complete rail (head, web and base) is then rapidly cooled with water or other appropriate quenching media to a temperature of less than 100° C. The preferred composition of the steel treated according to this alternative method is as follows:

0.70 to 0.80% carbon
0.40 to 0.50% silicon
0.90 to 1.20% manganese
≦0.035% phosphorous
≦0.040% sulfur
≦0.30% chromium
≦0.10% nickel
≦0.02% molybdenum
0.08 to 0.12% vanadium
0.02 to 0.05% columbium
0.012 to 0.018% nitrogen
0.010 to 0.050% aluminum the rest being iron and usual impurities.

BRIEF DESCRIPTION OF THE DRAWINGS

The method according to the invention is explained in detail by means of two graphs showing in FIG. 1 the temperature/time cycle of the heat-treatment for a steel having a defined analysis, FIG. 2 the hardness diagram of rails heat-treated according to the invention in the rail head portion at certain distances from the contact surface.

DETAILED DESCRIPTION OF THE INVENTION

Figure 1:
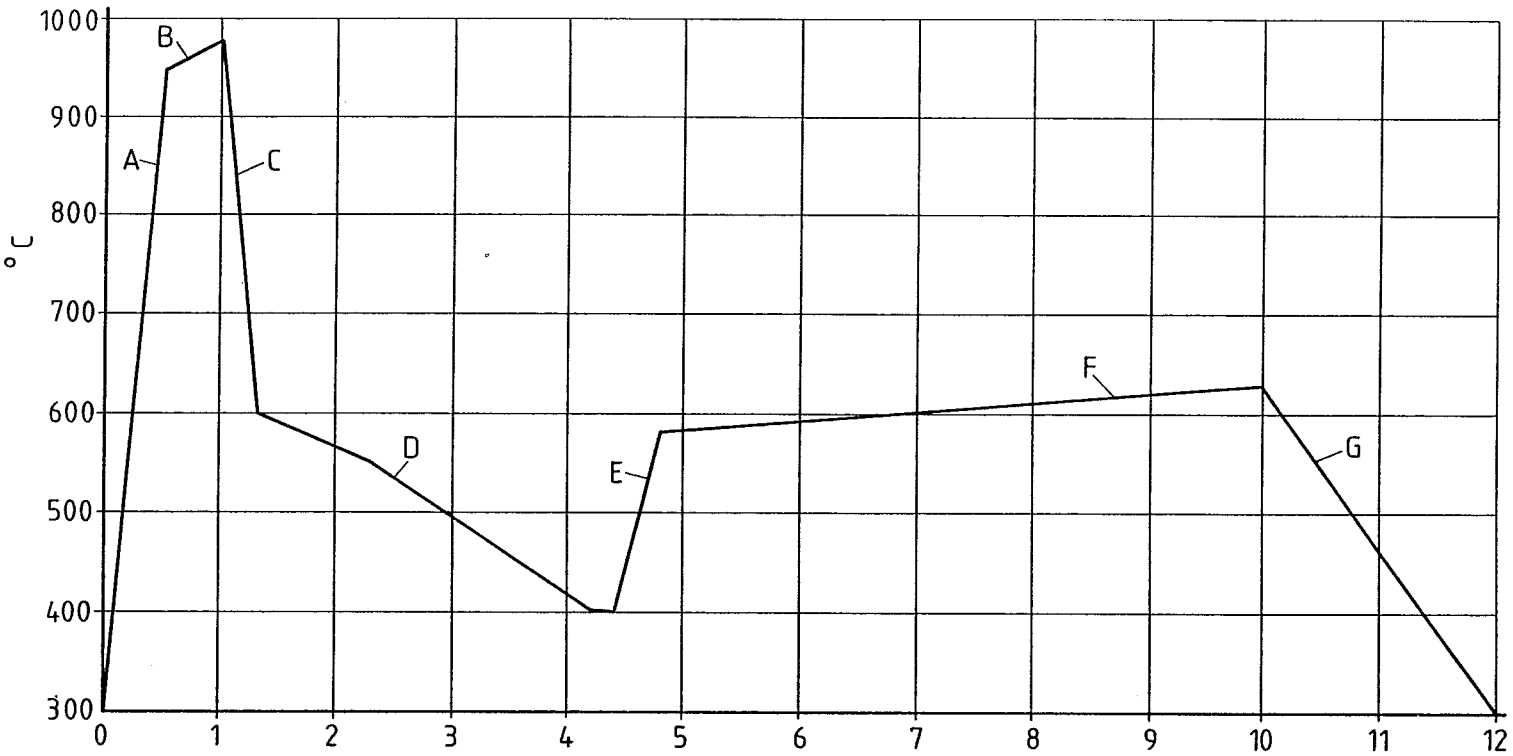

FIG. 1 indicates the temperatures in °C. to be adjusted when performing the new method during certain steps A to G as a function of the time in minutes for a rail steel having a chemical composition of 0.75% C, 0.46% Si, 1.05% Mn, 0.10% V, 0.04% Nb, 0.020% Al, 0.015% N, the rest being iron and usual impurities.

The process steps are:

A—heating to austenitisation temperature
B—maintaining at austenitisation temperature
C—rapid cooling until the start of the pearlite transformation
D—throttled cooling to about 400° C.
E—reheating to about 600° C.
F—maintaining at about 600° C.
G—cooling to about 100° C.

Figure 2:
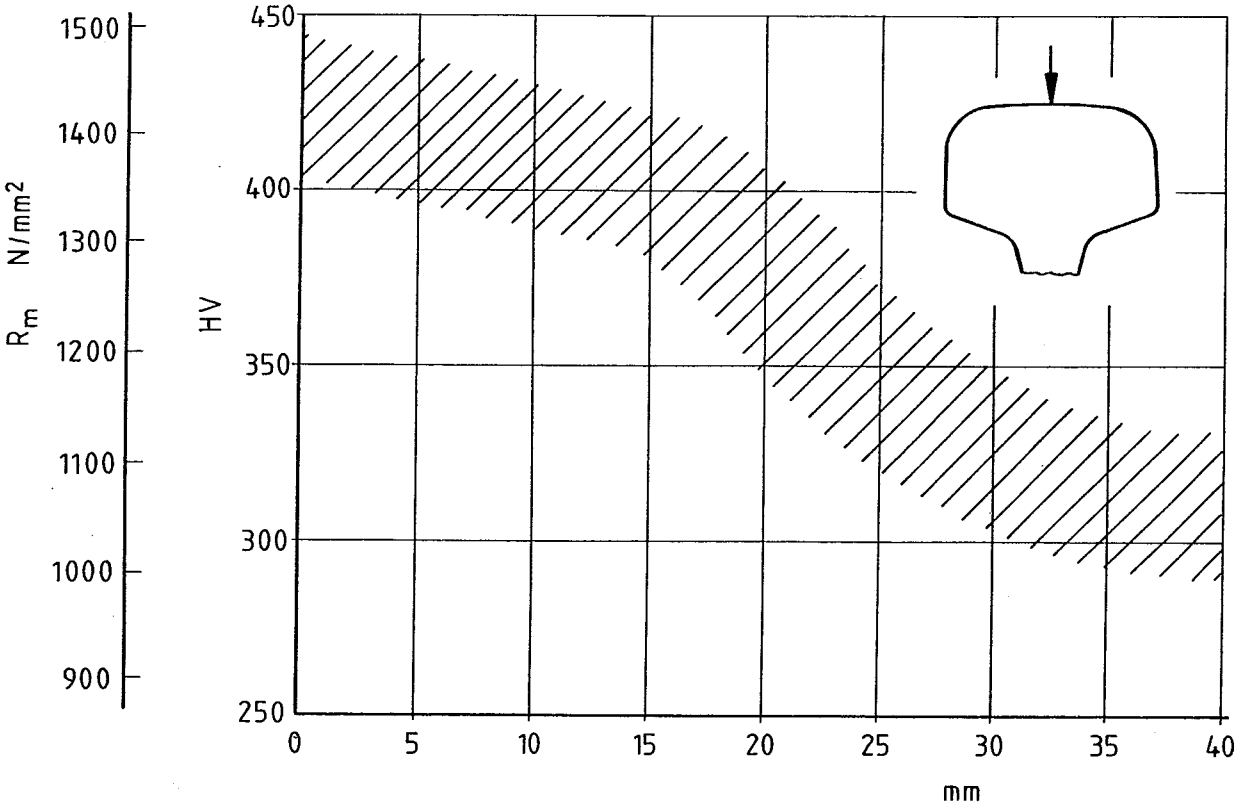

FIG. 2 indicates the hardness HV in the rail head portion as a function of the distance in mm from the rail contact surface, i.e. in the form of a dispersion range for steels heat-treated according to the invention and having the following guide analysis:

0.73 to 0.80% C, 0.40 to 0.50% Si, 0.90 to 1.20% Mn, 0.09 to 0.12% V, 0.03 to 0.05% Nb, 0.015 to 0.040% Al, 0.012 to 0.018% N, the rest being iron.

The lower area of the dispersion range applies for 0.73 to 0.75% C, 0.40 to 0.43% Si, 0.90 to 0.95% Mn, 0.09 to 0.10% V, 0.03 to 0.05% Nb, 0.015 to 0.040% Al, 0.012 to 0.014% N.

The upper area of the dispersion range applies for 0.78 to 0.80% C, 0.47 to 0.50% Si, 1.15 to 1.20% Mn, 0.11 to 0.12% V, 0.03 to 0.05% Nb, 0.015 to 0.040% Al, 0.016 to 0.018% N.

The tensile strength scale indicated adjacent to the hardness scale permits one to convert the hardness HV (Vickers hardness values) into strength values in $N/mm^2$ (N=Newton).

Within the above indicated guide analysis at the rail contact surface hardness values of 400 to about 445 HV corresponding to 1350 to 1500 $N/mm^2$ are obtained.

In a depth of 15 mm below the rail contact surface (=running surface) the hardness values of 380 to 425 HV range clearly above the required values of 360 HV.

The hardness diagram of the rail heat-treated according to FIG. 1 with the given chemical composition approximately meets the average values of the dispersion range according to FIG. 2.

We claim:

1. In a method for heat treatment of pearlitic rail steels in which for increasing strength and wear resistance at least the head portion of the rails is heated up to austenitisation temperature and thereafter cooled so rapidly that through transformation in the lower pearlite stage there is obtained a fine lamellar pearlite structure, the improvement wherein steels are used consisting of 0.55 to 0.82% carbon
0.25 to 0.50% silicon
0.80 to 1.30% manganese
≦0.035% phosphorous
≦0.040% sulfur
≦0.30% chromium
≦0.10% nickel
≦0.05% molybdenum
0.05 to 0.20% vanadium
0.02 to 0.10% columbium
0.010 to 0.025% nitrogen
0.010 to 0.070% aluminum the rest being iron and usual melt impurities, wherein the rail head portion is heated during the cycle to a sufficient depth of up to 50 mm by means of a gas burner or an electrical induction system to an austenitisation temperature in the range of about 950° to 1050° C., and wherein the rail head is subsequently cooled by means of compressed air in a first step during which a large amount of air is blown onto the workpiece the temperature of the rail head portion is cooled within 10 to 20 second to about 650° to 600° C. before the pearlite transformation area, and in a second step at reduced air blowing compared to the first step the material is cooled in the pearlite transformation area within 2 to 4 minutes to about 400° C. until the pearlite transformation is finished, and thereafter the rail head portion is again heated for 4 to 6 minutes to about 600° to 650° C. and then rapidly cooled by means of a quenching medium to a temperature of less than 100° C.

2. A method according to claim 1, wherein steels comprising 0.70 to 0.80% carbon
0.40 to 0.50% silicon
0.90 to 1.20% manganese
≦0.035% phosphorous
≦0.040% sulfur
≦0.30% chromium
≦0.10% nickel
≦0.02% molybdenum
0.08 to 0.12% vanadium
0.02 to 0.05% columbium
0.012 to 0.018% nitrogen
0.010 to 0.050% aluminum the rest being iron and usual impurities are heat treated.

3. A method according to claim 1, wherein in the first cooling step the compressed air is mixed with liquid media.

4. A method according to claim 1, wherein the austenitisation temperature ranges from about 950° to 1,000° C.

5. A method for heat treatment of pearlitic steels consisting of 0.55 to 0.82% carbon
0.25 to 0.50% silicon
0.80 to 1.30% manganese
≦0.035% phosphorous
≦0.040% sulfur
≦0.30% chromium
≦0.10% nickel
≦0.05% molybdenum
0.05 to 0.20% vanadium
0.02 to 0.10% columbium
0.010 to 0.025% nitrogen
0.010 to 0.070% aluminum the rest being iron and usual melt impurities, wherein after finishing hot-rolling of the rails at temperatures of about 950° to 1,000° C. compressed air is blown onto the rail head portion to provide a fine lamellar pearlitic structure in the rail head portion and after finishing the pearlite transformation at 400° C. the rail head portion is again heated up to about 600° to 650° C., whereafter the complete rail including head, web and base is rapidly cooled by means of a quenching media to a temperature of less than 100° C.

6. A method according to claim 5 wherein steels of the following composition are heat-treated:

0.70 to 0.80% carbon
0.40 to 0.50% silicon
0.90 to 1.20% manganese
≦0.035% phosphorous
≦0.040% sulfur
≦0.30% chromium
≦0.10% nickel
≦0.02% molybdenum
0.08 to 0.12% vanadium
0.02 to 0.05% columbium
0.012 to 0.018% nitrogen
0.010 to 0.050% aluminum the rest being iron and usual impurities.

* * * * *